US012678668B2

(12) United States Patent
Egnor, Jr.

(10) Patent No.: US 12,678,668 B2
(45) Date of Patent: Jul. 14, 2026

(54) PROTECTIVE CAP ASSEMBLY FOR A NEEDLE

(71) Applicant: Daniel Allen Egnor, Jr., Harvest, AL (US)

(72) Inventor: Daniel Allen Egnor, Jr., Harvest, AL (US)

( * ) Notice: Subject to any disclaimer, the term of this patent is extended or adjusted under 35 U.S.C. 154(b) by 1 day.

(21) Appl. No.: 18/999,087

(22) Filed: Dec. 23, 2024

(65) Prior Publication Data

US 2025/0213928 A1 Jul. 3, 2025

Related U.S. Application Data

(60) Provisional application No. 63/616,072, filed on Dec. 29, 2023.

(51) Int. Cl.
*A63B 41/12* (2006.01)

(52) U.S. Cl.
CPC ..... *A63B 41/12* (2013.01)

(58) Field of Classification Search
CPC ..... A63B 41/12; F16K 15/145; F16K 15/20; Y10S 128/919; A51M 5/3213; A51M 5/3202
USPC ..... 141/29; 604/198; 137/223
See application file for complete search history.

(56) References Cited

U.S. PATENT DOCUMENTS 2,969,082 A * 1/1961 Boyer ..... B60S 5/04 206/207
3,021,942 A * 2/1962 Hamilton ..... A61M 5/3202 604/243
4,124,025 A * 11/1978 Alrazi ..... A61B 5/150389 604/199
4,742,910 A * 5/1988 Staebler ..... A61M 5/3213 604/263
4,986,818 A * 1/1991 Imbert ..... A61M 5/3202 604/263
5,098,400 A * 3/1992 Crouse ..... A61M 5/3204 604/263
5,279,578 A * 1/1994 Cooke ..... A61M 5/3213 604/263
5,304,148 A * 4/1994 Lannoye ..... A61M 5/3213 128/919
7,488,307 B2 * 2/2009 Rimlinger ..... A61M 5/3202 604/110
8,602,211 B2 * 12/2013 Sasur ..... B65D 85/24 206/382
10,842,248 B2 * 11/2020 Ishayik ..... A45F 5/00
2005/0006328 A1 * 1/2005 Manix ..... A63B 41/12 211/89.01
2006/0213793 A1 * 9/2006 Brand ..... A61M 5/3213 206/366

(Continued)

*Primary Examiner* — Kenneth Rinehart
*Assistant Examiner* — Stephanie A Shrieves
(74) *Attorney, Agent, or Firm* — Dunlap Bennett & Ludwig PLLC

(57) ABSTRACT

A needle protection assembly with a cap that connects directly to a needle, thereby protecting the stem from bending. The needle protection assembly further provides a base ring for circumscribing a base portion of the needle and a bushing that interconnects the cap and the base ring, wherein there is no fixed connection between the cap and the bushing nor between the bushing and the base ring so that the bushing can rack relative to the base ring when a deflection force is imparted on the cap.

10 Claims, 4 Drawing Sheets

(56) References Cited

U.S. PATENT DOCUMENTS

2015/0337975 A1* 11/2015 Allen ..... F16K 15/202
137/232

* cited by examiner

PROTECTIVE CAP ASSEMBLY FOR A NEEDLE

CROSS REFERENCE TO RELATED APPLICATION

This application claims the benefit of priority of U.S. provisional application No. 63/616,072, filed 29 Dec. 2023, the contents of which are herein incorporated by reference.

BACKGROUND OF THE SUBJECT MATTER

The subject disclosure relates to needles and, more particularly, a protective cap over a needle to increase its resistance to bending and breaking, thus increasing its useful lifespan. In addition, the subject disclosure provides for a protective cap over the pointed end of a needle to reduce the risk of injury and damage to the needle.

Inflations needles, such as ones used to inflate balls, tires and the like are thin and susceptible to bending and breaking. Furthermore, due to their narrow shape can injure users.

Examples of existing needle protection solutions include protective caps for injection needles (not inflation needles) that are designed to attach to the body of a specific kind of syringe that is operatively associated with the injection needle. This limits the applicability of such protective caps to a limited number of compatible syringes.

And so, those seeking to protect an inflation needle using injection-needle solutions tend to be similarly frustrated by the disadvantage of the cover/cap being geared to be attached to specific underlying body of the inflation needle, thereby precluding universality. Air inflation needles employ a plurality of underlying body types and shapes (e.g., the underlying body could be the handle of the pump that the air inflation needle directly couples to, or the like).

As can be seen, there is a need for a protective cap for a needle wherein the protective cap prevents the needle from bending and breaking and wherein the protective cap improves on the prior art by only directly attaching to the needle itself, and not the underlying body, thereby affording universality in a sea of one-trick ponies.

SUMMARY OF THE SUBJECT MATTER

The device embodied in the subject disclosure slides over a needle, providing a cap that covers the needle and prevents the needle from bending and breaking through its connection to the base portion of the needle. Also, the cap portion prevents exposure to the point of the needle, reducing the risk of injury. The subject disclosure has applicability across a variety of needle types and is not limited to only inflation needles.

In one aspect of the present subject matter, a needle protection assembly provides a cap that connects directly to a stem of the needle; a base ring circumscribing a base portion of the needle; and a bushing that interconnects the cap and the base ring, wherein there is no fixed connection between the cap and the bushing nor between the bushing and the base ring so that the bushing can rack relative to the base ring when a deflection force is imparted on the cap.

In another aspect of the present subject matter, the needle protection assembly further provides the following: wherein the cap defines a cap lumen, wherein the bushing defines a bushing lumen, and wherein said stem is received in the bushing lumen and the cap lumen, wherein the cap receives at least three-fourths of the stem, wherein the cap and the bushing are elastomeric and configured to snugly engage the received stem; and further providing the following: the base ring has a base wall; a sidewall perpendicularly extends from a periphery of the base wall so that an inner circumference of the sidewall defines a compartment and a first opening thereto; and the base wall defining a second opening, opposite the first opening, to the compartment, wherein the second opening circumscribes the base portion of the needle, wherein the second opening snugly engages said base portion; and further providing a pedestal concentrically supporting the bushing, and wherein the pedestal has a pedestal diameter greater than a diameter of the bushing, wherein the pedestal is seated in the compartment, whereby there is an up to one millimeter clearance between a circumferential surface of the pedestal and said inner circumference of the sidewall, wherein the received stem concentrically orients the cap relative to the bushing, and wherein the cap is seated on the bushing.

These and other features, aspects and advantages of the present subject matter will become better understood with reference to the following drawings, description and claims.

DETAILED DESCRIPTION OF THE SUBJECT MATTER

Figure 1:
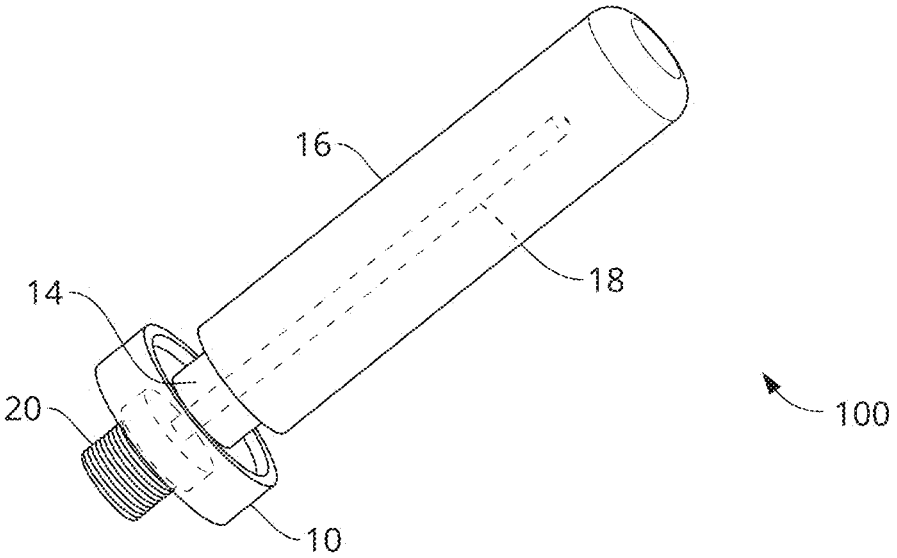
FIG. 1 is a perspective elevation view of an exemplary embodiment of the subject disclosure, shown in an installed condition on a needle.
Figure 2:
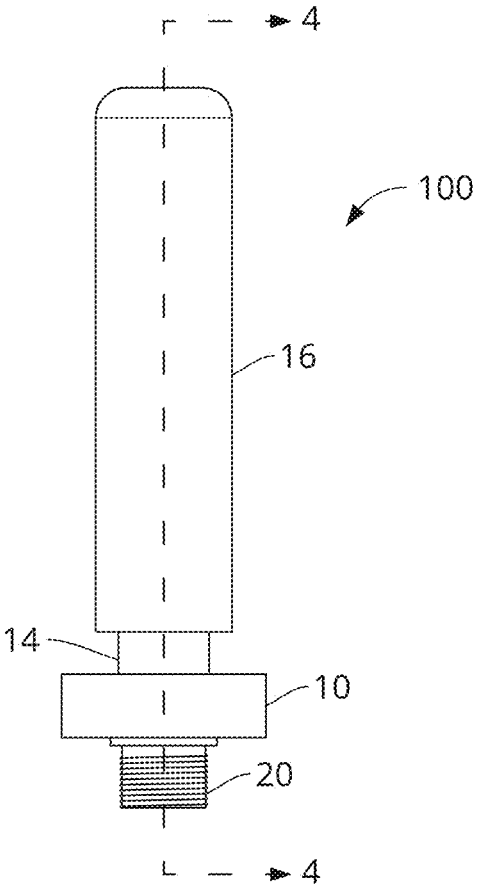
FIG. 2 is an elevation view of an exemplary embodiment of the subject disclosure, shown in the installed condition.
Figure 3:
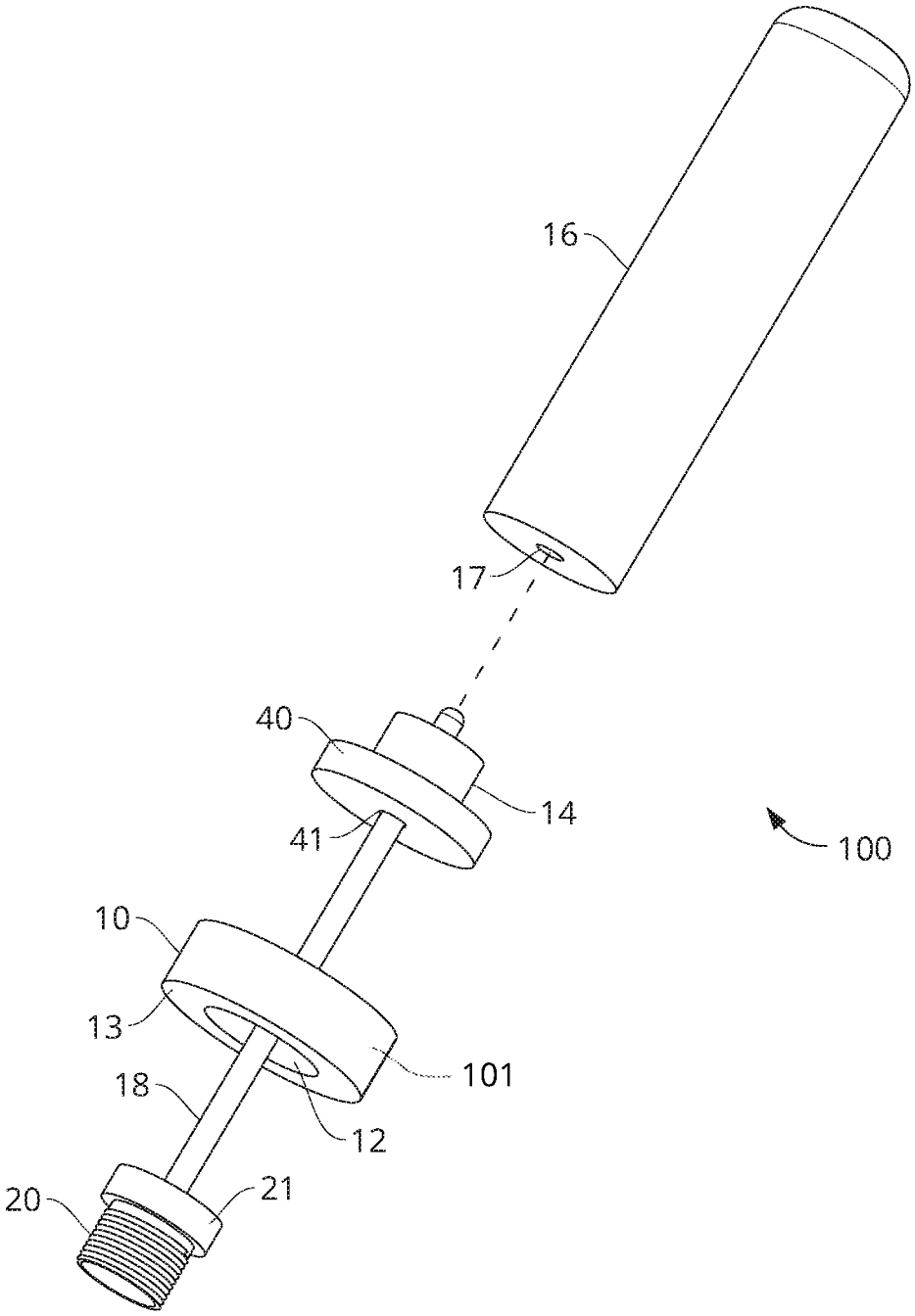
FIG. 3 is an exploded perspective view of an exemplary embodiment of the subject disclosure in the installed condition.

The following detailed description is of the best currently contemplated modes of carrying out exemplary embodiments of the subject matter. The description is not to be taken in a limiting sense but is made merely for the purpose of illustrating the general principles of the subject matter, since the scope of the subject matter is best defined by the appended claims.

Referring now to FIGS. 1 through 9, the subject disclosure provides a protective capping system, device, and method embodying a protective cap assembly 100 for covering a needle stem 18 with an integrated needle base portion 21, whereby the protective cap assembly 100 is directly joined to the stem 18 and possibly the base portion 21, avoiding fixed connections with anything below the base portion 21, thereby enabling universality as compared to the prior art.

The protective cap assembly 100 has more than one embodiment. In one embodiment, the protective cap assembly 100 may include a base ring 10 defining a cavity or compartment 22 that communicates with the external environment through a "top"/first opening 11 and through a "bottom"/second opening 12 along an opposing side of the base ring 10. The diameter of the first opening 11 may be substantially greater than the diameter of the second opening 12. Specifically, the second opening 12 may be dimensioned and shaped to receive, slidably or otherwise, the base portion 21 of the needle 18 so that the needle projects through and beyond the compartment 22. During use, the installed condition, the bottom/base wall 13 of the base ring 10 may be concentric and substantially co-planar with the base portion 21 of the needle 18 as the base portion 21 occupies the void of the second opening 12. There may be a gap between the surface of the inner sidewall defining the second opening 12 and the outer circumference of the base portion 21.

The protective cap assembly 100 may also include a needle bushing 14. The needle bushing 14 may be seated on a pedestal 40 having a greater diameter than the needle bushing 14, as illustrated in FIGS. 1 through 5. A through hole 41 extends through both for snugly receiving the stem 18. The through hole 41 may define a shared axis of the pedestal 40 and the generally concentrically disposed needle bushing 14. The needle bushing 14 may be adapted as an isolator that interfaces between the needle 18 and the base ring 10 as well as a cap portion 16 to dampen energy. The needle bushing 14 and its supportive pedestal 40 may be made from elastomeric material to provide the requisite frictional resistance along the stem 18 to prevent it from slipping out due to gravity.

Figure 4:
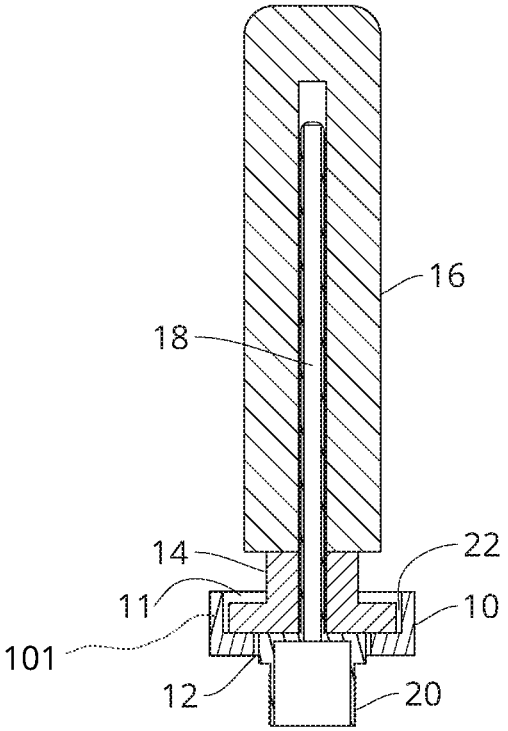
FIG. 4 is a section view of an exemplary embodiment of the subject disclosure, taken along line 4-4 in FIG. 2.

The first opening 11 is dimensioned so that the pedestal 40 fits in compartment 22 and sits on an upper surface of the base wall 12 of base ring 10. There may be a gap between the inner sidewall of the base ring 10 (that defines the diameter of the compartment 22) and the outer circumference of the pedestal 40, as seen in FIG. 4.

The protective cap assembly 100 may provide a cap portion 16 or closed sleeve having a lumen 17 for slidably receiving the needle stem 18 therein. In the embodiments illustrated in FIGS. 6 through 9, the open end of the cap 30 may be dimensioned and shaped to slidably and snugly receive the outer circumference of the needle bushing 36. In other embodiments, as illustrated in FIGS. 1 through 5, the open end merely provides the lumen through hole 17 for the stem 18, while the remainder of the open end—i.e., the surface surrounding the through hole 17—is the area or footprint that sits on an upper surface of the needle bushing 14.

In the installed condition, the assembly 100 covers the needle and prevents bending and breaking of the needle stem 18 through the arrangement of the base ring 10, which seats the needle bushing 14, and the cap 16 that slidably and snugly receives and frictionally grips the stem 18.

In some embodiments, the cap 30 may provide an inner cap 32 that lines the lumen of the cap 30 so that the needle stem 18 is gripped by the inner cap 32. The external shape of the different cap configurations 16, 30, or 34 may have a uniform cylindrical shape or a tapering shape as illustrated in FIGS. 6 through 9. While in other embodiments, the external shape can come in a variety of forms—i.e., the shape could be that of a sports mascot; in another, that of a hook used for hanging.

In one embodiment, the base ring 10 and needle bushing 14 may be a unitary construction or unitary base 36 having a bottom recess that receives the base portion 21 of the needle, while the remainder of the unitary base 36 is solid but for a through hole through which the needle stem 18 is received during use.

In one embodiment, the base ring 10 snap fits to the needle's base portion 21 by the circumference of the inner sidewall 15 snugly fitting on the outer circumference of said base portion 21. In other embodiments, there is no snug interconnection between the base portion 21 and the inner sidewall 15, but because the needle 18 is fluidly coupled to and supported on a pump-related conduit (not shown) or handle (not shown) the base ring 10 does slide off the base portion 21. Then the user slides the bushing 14 along the stem 18 of the needle, whereby the cap 16, 30, or 34 is fixed to the stem 18, thereby protecting it from deflection or bending.

Figure 5:
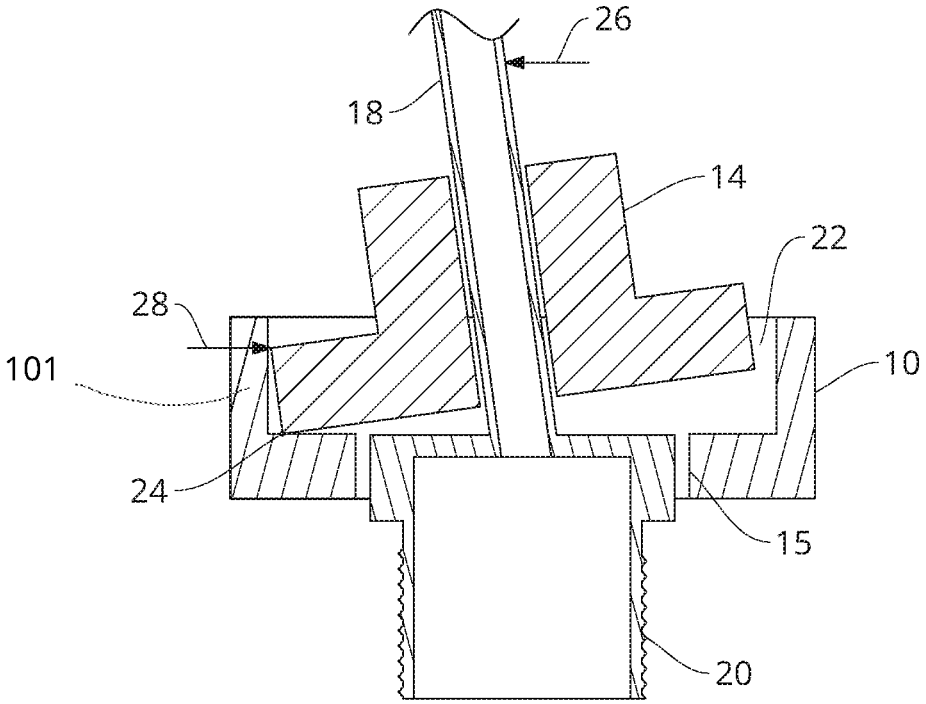
FIG. 5 is a detailed section view of an exemplary embodiment of the subject disclosure, illustrating the interplay between a deflecting force 26 and a restorative force 28.
Figure 6:
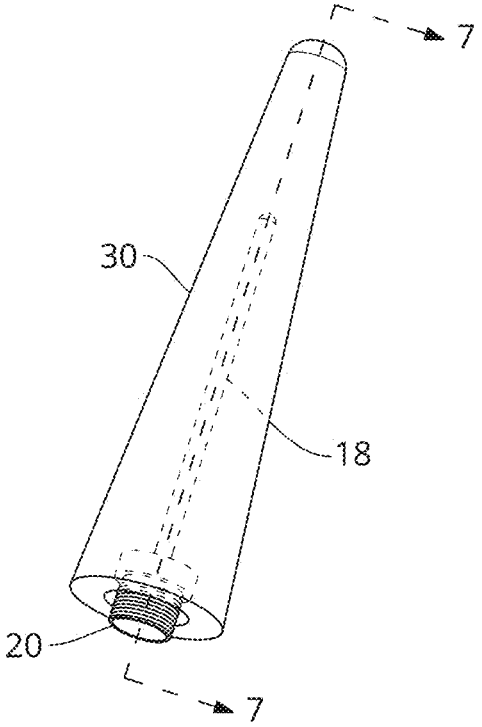
FIG. 6 is a perspective view of an exemplary embodiment of the subject disclosure, illustrating the protected needle stem 18 in ghost lines for illustrative purposes.
Figure 7:
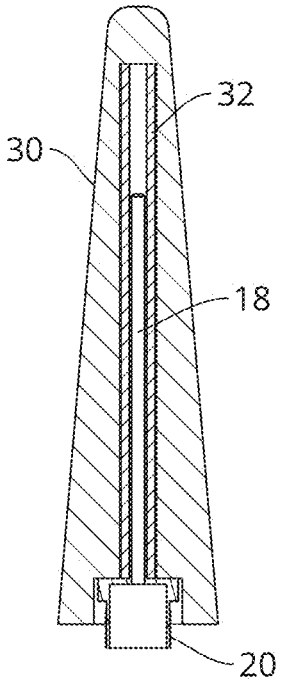
FIG. 7 is a section view of an exemplary embodiment of the subject disclosure, taken along line 7-7 in FIG. 6.
Figure 8:
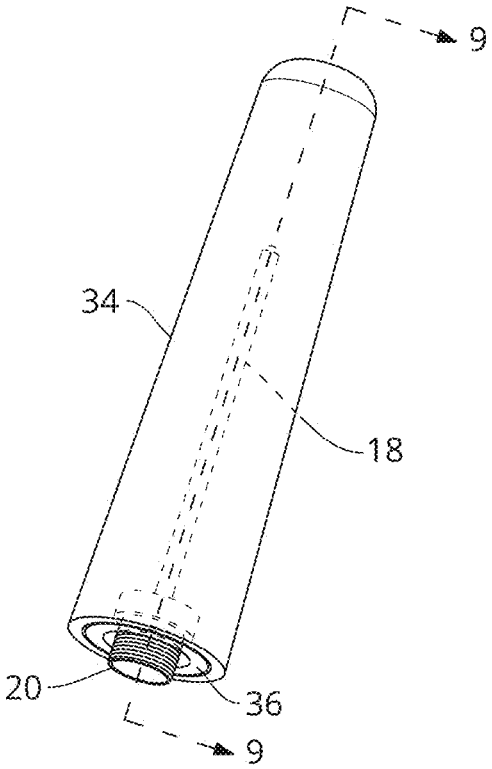
FIG. 8 is a perspective view of an exemplary embodiment of the subject disclosure, illustrating the protected needle stem 18 in ghost lines for illustrative purposes.
Figure 9:
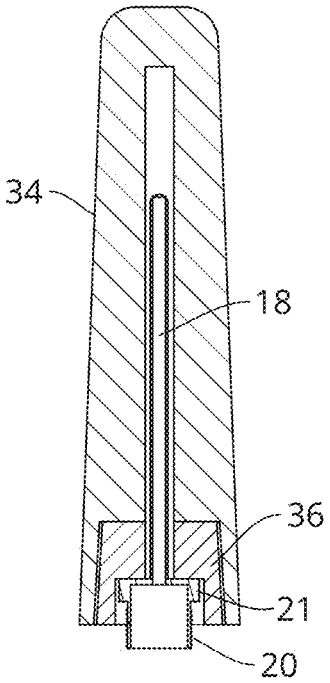
FIG. 9 is a section view of an exemplary embodiment of the subject disclosure, taken along line 9-9 in FIG. 8.

Referring to FIG. 5, the purpose of the bushing 14 having a pedestal 40 seated within the compartment 22 of the base ring 10 is to provide a physical constraint that limits the deflection when the protected needle is deflected by a deflecting force 26. As a result of constraining the deflection of the bushing 14, the deflection of the needle is constrained as well. It is this constraint that limits the deflection of the needle that would otherwise result in permanent deformation or breaking.

The clearance between the bushing 14/40 and the base ring 10 is needed to decouple these non-fixed elements, which in turn generate a restoring force 28. This decoupling permits some deflection of the needle, not enough to cause damage, before the restoring force 28 results when the pedestal 40 "racks" within the circumscribing sidewalls 101 of the base ring 10.

The decoupling between the bushing 14 and the base ring 10 engenders the novel sequential combination of tolerance (from the clearance, say up to half a millimeter, between the bushing 14 and base ring 10 sidewall 101) followed by the restoring force 28 against the corner of the pedestal 40. Which in turn prevents the cap 16 from rotating off the base portion 21 when the needle is deflected while simultaneously providing a restoring force that resists the deflection. Thus, the tip of the stem 18 may deflect a millimeter relative to its base portion 21 before the restorative force 28 stops the deflection.

The restoring force 28 provides a degree of resistance to the deflecting force 26 which increases the magnitude of the deflecting force required to deflect the needle to the point of permanent deformation or breaking. As a result, the needle can be subjected to higher deflecting forces without damage. This has the desired benefit of extending the lifespan of the needle and decreasing the likelihood of the needle breaking and remaining stuck in the opening in which the needle is inserted.

In the other embodiments, see FIGS. 6 through 9, with the single integral bushing 36, when the needle is deflected, the bushing 36 tends to rotate about a point of rotation and the load path flows through the integral bushing 36 preventing tipping and thus deleterious bending.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the subject matter and that modifications may be made without departing from the spirit and scope of the subject matter as set forth in the following claims.

What is claimed is:

1. A needle protection assembly, comprising:

a cap that connects directly to a stem of the needle;

a base ring circumscribing a base portion of the needle; and a bushing that interconnects the cap and the base ring, wherein there is no fixed connection between the cap and the bushing nor between the bushing and the base ring so that a pedestal of the bushing racks relative to the base ring when a deflection force is imparted on the cap.

2. The needle protection assembly of claim 1, wherein the cap defines a cap lumen, wherein the bushing defines a bushing lumen, and wherein said stem is received in the bushing lumen and the cap lumen.

3. The needle protection assembly of claim 2, wherein the cap receives at least three-fourths of the stem.

4. The needle protection assembly of claim 2, wherein the cap and the bushing are elastomeric and configured to snugly engage the received stem.

5. The needle protection assembly of claim 4, further comprising:

the base ring has a base wall;

a sidewall perpendicularly extends from a periphery of the base wall so that an inner circumference of the sidewall defines a compartment and a first opening thereto; and the base wall defining a second opening, opposite the first opening, to the compartment, wherein the second opening circumscribes the base portion of the needle.

6. The needle protection assembly of claim 5, wherein the second opening snugly engages said base portion.

7. The needle protection assembly of claim 5, wherein the pedestal concentrically supports the bushing, and wherein the pedestal has a pedestal diameter greater than a diameter of the bushing.

8. The needle protection assembly of claim 7, wherein the pedestal is seated in the compartment, whereby there is an up to one millimeter clearance between a circumferential surface of the pedestal and said inner circumference of the sidewall.

9. The needle protection assembly of claim 8, wherein the received stem concentrically orients the cap relative to the bushing.

10. The needle protection assembly of claim 9, wherein the cap is seated on the bushing.

* * * * *